US008776689B2

(12) United States Patent
Gonsalves et al.

(10) Patent No.: US 8,776,689 B2
(45) Date of Patent: Jul. 15, 2014

(54) ENERGETICS TRAIN REACTION AND METHOD OF MAKING AN INTENSIVE MUNITIONS DETONATOR

(76) Inventors: Vincent Gonsalves, Nazareth, PA (US); Bekim Isovski, Clifton, NJ (US); Larry Sotsky, Rockaway, NJ (US); Stojan Kotefski, Bloomingdale, NJ (US); Lidija Kotevska, Bloomingdale, NJ (US)

( * ) Notice: Subject to any disclaimer, the term of this patent is extended or adjusted under 35 U.S.C. 154(b) by 0 days.

(21) Appl. No.: 13/071,731

(22) Filed: Mar. 25, 2011

(65) Prior Publication Data

US 2012/0240806 A1 Sep. 27, 2012

(51) Int. Cl.
*C06C 7/00* (2006.01)

(52) U.S. Cl.
USPC ..... 102/275.11; 102/275.12; 102/277.1

(58) Field of Classification Search
USPC ..... 102/202.1, 202.12, 202.13, 275.11, 102/277.1
See application file for complete search history.

(56) References Cited

U.S. PATENT DOCUMENTS

| | | | | | |
|---|---|---|---|---|---|
| 3,212,439 | A * | 10/1965 | Reyne | 102/202.14 |
| 3,589,294 | A * | 6/1971 | Stresau | 102/210 |
| 3,618,523 | A * | 11/1971 | Hiquera et al. | 102/202.6 |
| 3,981,240 | A * | 9/1976 | Gladden | 102/202.4 |
| 4,073,235 | A * | 2/1978 | Hopler, Jr. | 102/200 |
| 4,312,271 | A * | 1/1982 | Day et al. | 102/202.13 |
| 4,616,566 | A * | 10/1986 | Yates, Jr. | 102/318 |
| 4,727,808 | A * | 3/1988 | Wang et al. | 102/202.5 |
| 4,898,095 | A * | 2/1990 | Tasaki et al. | 102/201 |
| 5,003,879 | A * | 4/1991 | Jones | 102/204 |
| 5,046,567 | A * | 9/1991 | Aitken et al. | 175/4.6 |
| 5,125,335 | A * | 6/1992 | Grommes et al. | 102/202.13 |
| 5,385,098 | A * | 1/1995 | Lindqvist et al. | 102/205 |
| 5,567,912 | A * | 10/1996 | Manning et al. | 149/12 |
| 5,945,627 | A * | 8/1999 | Arpin et al. | 102/202.11 |
| 6,408,759 | B1 * | 6/2002 | Ewick et al. | 102/202.5 |
| 6,578,489 | B2 * | 6/2003 | Boyer et al. | 102/272 |
| 6,578,490 | B1 * | 6/2003 | Francisco | 102/275.11 |
| 6,736,068 | B1 * | 5/2004 | Dumenko et al. | 102/205 |
| 7,146,913 | B2 * | 12/2006 | Bell | 102/322 |
| 7,712,419 | B1 * | 5/2010 | Cheng et al. | 102/487 |
| 8,051,775 | B2 * | 11/2011 | Henderson et al. | 102/275.6 |
| 8,286,555 | B2 * | 10/2012 | Wuensche et al. | 102/275.11 |
| 2008/0223242 | A1 * | 9/2008 | Aube | 102/202.13 |
| 2011/0239889 | A1 * | 10/2011 | Henderson et al. | 102/320 |

* cited by examiner

*Primary Examiner* — Bret Hayes
*Assistant Examiner* — Derrick Morgan
(74) *Attorney, Agent, or Firm* — Scully, Scott, Murphy & Presser, P.C.

(57) ABSTRACT

A detonator formed entirely from a plurality of discrete segments of an insensitive energetic composition, each of the segments employed in the detonator being compacted at different pressures from powder and/or granules of insensitive energetic composition so as to form an energetic train which sequences detonation of the individual segments. Initiation of a main charge can only be effected when a last segment in the detonation train is initiated. Detonation starts with a first segment in the detonation train which is produced under the lowest compaction pressure, and then detonation progresses to a last segment compacted under a higher compaction pressure. The first segment can be detonated by a safety fuse or detonating cord, and the last segment can only be detonated by the next to the last segment in the detonation train.

5 Claims, 6 Drawing Sheets

ENERGETICS TRAIN REACTION AND METHOD OF MAKING AN INTENSIVE MUNITIONS DETONATOR

STATEMENT OF GOVERNMENT INTEREST

This invention was in part made with government support under contracts awarded by the U.S. Army. The government has certain rights in the invention.

BACKGROUND OF THE INVENTION

1. Field of the Invention

The present invention relates in general to explosive devices including pyrotechnic devices, munitions, and rockets which utilize a detonator assembly and, more particularly, to a detonator formed entirely from insensitive energetic compositions, and to a method of making same.

2. Background Art

Under their normal condition of use, modern munitions are both effective and relatively safe, and they are unlikely to explode or burn spontaneously despite the fact that they are composed primarily of energetic material. The energetic materials, i.e., high explosives, gun propellants, rocket propellants, etc. found in munitions of all types are sensitive to heat and to mechanical shock. Consequently, they can be triggered by fire or by impact with bullets or fragments.

A range of energetic materials can be used in low-risk munitions: explosives and propellants less vulnerable than their predecessors to both slow and rapid heating (cook off) and to impact by bullets or fragments of exploding shells. For gun propellants, the single, double and triple base formulations now in service can be replaced by others based on components that are more energetic but less sensitive. In the case of warheads, efforts are being made to replace explosives such as TNT, which is very sensitive to heat and shock, with a more stable plastic-bonded explosives which are better able to withstand adverse conditions. These new explosives and gun propellants are made primarily with energetic crystals such as RDX and HMX, contained in new energetic binders and plasticizers.

An insensitive munition (IM) is one that will not detonate under any conditions other than its intended mission to destroy a target. If it is struck by fragments from an exploding shell or struck by a bullet, it will not detonate. Also, it will not detonate if it is in close proximity to a target that is struck. Further, in extreme temperatures, the munition will only burn without creating/generating an explosion or a detonation.

To reduce the chance of accidental explosions or fires, the U.S. military is interested in replacing existing main charge explosives with newer more insensitive explosives such as PBXN-103 and PBXN-109. Existing booster explosives and fuses have insufficient energy output to reliably initiate the new insensitive main charge explosives. The existing Department of Defense inventory of fuses and booster explosives is very large and cannot be replaced without considerable cost. What is needed is an inexpensive method of reliably initiating the new, more insensitive main charge explosives while at the same time reducing the chance of an accidental initiation of a fuse or detonator system.

The U.S. Department of Defense is interested in reducing weapon vulnerability and improving weapon safety in extreme and abnormal environments. Insensitive munitions are one way to achieve these goals. A fuse train is needed that will ignite these insensitive munitions at extremes of temperature, but will not compromise the insensitivity of HE main charge fill to external threats (U.S. Pat. No. 5,275,106).

U.S. Pat. No. 5,567,912 discloses that insensitive munitions are prepared by making an energetic composition, processing the composition into intermediate shapes and fabricating an article from the intermediate shape. The article may itself be directed to military use such as a munition or ammunition, and it may also be directed to civilian uses such as demolition charges. In these applications, the explosive is formed into an article that will have blasting effects when exploded. The explosive article is assembled along with other items, such as propellants, fuses, guidance systems, etc. into the munition. The munition can be a small caliber bullet, a large caliber shell, a warhead, a rocket, a bomb, a mortar, a hand grenade, torpedo, mine or similar device. It can be loaded into a weapon such as an artillery piece, a tank or armored vehicle.

U.S. Pat. No. 5,567,912 also discloses that an insensitive munition may be formed from crystalline heterocyclic nitramines HMX and RDX. These materials have very high energy densities and are well known in the field. They have been used in ammunitions and munitions for over sixty years and a very large body of data have been developed for their manufacture and safe use in munitions in both propellants and explosives.

HMX and RDX have been type classified and described with military specifications in most countries in the world. HMX has a higher energy density than RDX. These materials are available in the form of fine powders.

A conventional explosive is illustrated in FIG. 1 and includes a conventional melt poured or pressed main charge shown generally at 1 which may or may not be formed from an insensitive munition. Detonation of the main charge is effected by means of a detonator 3. The detonator is initiated by a fuse 5 in the form of a shock cord. The shock cord 5 in turn initiates detonator 3, which includes lead styphnate 7, which in turn initiates an adjacent charge of lead azide 9, which in turn initiates a charge 11 of RDX. The detonator energetics are Non-Insensitive Munitions (IM) compliant due to the presence of lead styphnate 7 and lead azide 9. In the embodiment shown in FIG. 1, detonator 3 is initiated via shock cord 5 or other fuse means, which starts the energetic train from lead styphnate 7 to lead azide 9 to RDX 11, which finally has the shock energy and velocity to detonate main energetic 1.

Even though a main charge in a pyrotechnic device may be an insensitive energetic, detonators employing lead azide and lead styphnate are in fact very sensitive to shock, friction and static discharges, even from the human body. Both of these lead compounds have a very high explosive detonation velocity of about 5200 meters per second. Moreover, lead azide has an auto ignition of 350° C., and lead styphnate has an auto ignition of 330° C. In addition, as with other lead containing compounds, both lead styphnate and lead azide are inherently toxic to humans if ingested, i.e., they can cause heavy metal poisoning.

In addition, lead styphnate and lead azide are highly sensitive and are usually handled and stored under water in insulated rubber containers. They will explode after a fall of no more than about six inches or in the presence of a static discharge of 7 millijoules. These properties make these materials highly dangerous and expensive to use in manufacturing pyrotechnic devices. For these reasons, a detonator which is effective without the use of lead azide, lead styphnate, or any other highly sensitive explosive material is needed in pyrotechnic devices, especially those having a main charge of insensitive energetic.

Current detonator designs used in many types of munitions are also illustrated in FIG. 2. These detonators in FIG. 2 have been available for many years and represent the current military and commercial standard. There are several designs that are fabricated and include M2, M10 and M14 detonators. These are typical detonators units that have a wide industrial and commercial usage. In the design in FIG. 2 shown generally at 13 is a shock cord 15 which initiates detonation of the lead styphnate 17, which in turn detonates the adjacent lead azide 19, which in turn detonates an RDX charge 21, which in turn detonates the main charge (not shown).

The current design in FIG. 3 of hand grenades shown generally at 23 includes a fuse assembly which is similar to a detonator assembly as previously described above, except the shock cord is replaced with a primer 25 and delay mix 27. In this conventional hand grenade 23, the handle 29 is pulled away from the body 31 of the grenade 23 to initiate detonation of the primer 25. The primer then initiates detonation of delay mix 27, which in turn initiates detonation of lead styphnate 33, which in turn initiates detonation of lead azide 35, which in turn detonates an adjacent RDX charge 37. It is the RDX charge 37 which initiates detonation of the main energetic filling 39 in body 31 of hand grenade 23.

The RDX charge in current detonators is formed by compaction of the powder or granular RDX. This process is carried out by forcing powdered or granular RDX into a die cavity by means of a mandrel to compress and compact the RDX powder.

It is therefore an object of the present invention to provide a detonator for insensitive high explosives.

It is a further object of the present invention to provide a fuse train for insensitive high explosives which is free of either lead azide or lead styphnate.

It is a still further object of the present invention to provide an insensitive fuse train capable of initiating insensitive munitions at extreme temperatures and without the use of a sensitive high explosive like lead azide and/or lead styphnate.

It is further another object of the present invention to provide insensitive munitions which cannot be initiated by various stimuli including cook-off (high temperatures), bullet/fragment impacts, and shape charge impacts.

In view of the aforementioned drawbacks associated with the use in detonators of lead azide and lead styphnate, there remains a need in the art for an improved detonator system which is safe and reliable and insensitive to shock, radio waves and heat for initiating a main charge of insensitive explosives.

BRIEF SUMMARY OF THE INVENTION

The present inventor conducted extensive experimentations, and unexpectedly discovered a detonator which achieves the foregoing described objects of the present invention. The detonator of the present invention eliminates the need for lead azide and/or lead styphnate by employing a detonator train comprising a plurality of insensitive energetic segments, each of which is formed by compacting powder or granules of an insensitive energetic. A first segment in the detonation train of the insensitive energetic is compacted under a pressure which is low enough to facilitate initiation of the first segment by a shock cord or fuse. Additional segments in the detonation train are compacted under pressures higher than the pressures used in compacting the first segment since these additional segments are designed so as not to be detonated by the shock cord or fuse, but instead only by segments of insensitive explosive in the detonation train.

The last segment of insensitive energetic in the detonation train is compacted to a high enough pressure that it will not be detonated by the shock cord or fuse, but instead only by detonation of a next to the last segment of insensitive energetic in the detonation train.

In this scenario, the last segment compacted under the highest pressure is the toughest segment to initiate. This difficult to initiate property is ideal in cases where insensitive munitions are desired. Using RDX as an example, varying the pressing forces in terms of psi can produce an energetic segment that does not initiate from the stimuli of a primer as in the case of a grenade fuse assembly into a detonator assembly capable of using only an RDX energetic with differing laminations or presses of the energetic.

In this case, the normal or ideal RDX pressing pressure of about 4,000 psi produces a last segment in a detonator train which is difficult to initiate and, therefore, requires that other energetic materials be used to initiate it in a detonator assembly. To achieve the objects of the present invention, other segments of RDX (or other insensitive energetic) are used which have been compressed to a pressure of less than about 4,000 psi and which, when initiated, produce an explosion sufficient to initiate the last segment in the train.

By employing a detonator train of insensitive energetic segments which have been compressed under diminishing compression forces, the detonator of the present invention produces a sequence of detonations proceeding from a first segment compacted under the lowest pressure to the last segment compacted under the highest pressure.

In a first preferred embodiment of the present invention there is provided in an explosive pyrotechnic device, military munition, or rocket comprising:

(a) a main charge of explosive or propellant formed primarily of an insensitive energetic composition;

(b) a detonator to trigger or initiate the main charge, said detonator being primarily formed of an insensitive energetic composition;

(c) a fuse, shock cord or primer to trigger or initiate the detonator;

the following improvement comprising:

a detonator formed entirely from a plurality of discrete segments of an insensitive energetic composition, each segment being formed by compacting under pressure powdered or granular insensitive energetic composition having a sensitivity to detonation which decreases with an amount of compressive force applied in compaction of the powder or granules of the insensitive energetic composition, said plurality of discrete segments comprising at least a first and last discrete segment of compacted insensitive energetic composition, each having been formed under different compaction pressures;

said first segment being compacted under a compaction pressure low enough that ignition of the fuse or primer will effect detonation of said first segment without detonating either the main charge or any other segment of the insensitive energetic composition, said last segment being subjected to a compaction pressure high enough that only ignition of another segment will initiate detonation of said last segment, which in turn initiates detonation of said main charge, thereby eliminating the need in the detonator for lead azide and lead styphnate.

In a second preferred embodiment of the present invention there is provided in connection with the first preferred embodiment a detonator wherein the plurality of segments employed in the detonator are each compacted under different pressures from powder or granules of insensitive energetic composition so as to form an energetic train which sequences detonation of the individual segments starting with the segment produced under the lowest compaction pressure, and then progress to segments compacted under higher compaction pressures.

In a third preferred embodiment of the present invention there is provided in connection with the first preferred embodiment a detonator formed from granules and/or powdered RDX.

In a fourth preferred embodiment of the present invention there is provided in connection with the first preferred embodiment a detonator formed from granules and/or powdered HMX.

In a fifth preferred embodiment of the present invention there is provided in connection with the third preferred embodiment a detonator in which the first segment is compacted under a pressure of about 2,000 psi.

In a sixth preferred embodiment of the present invention there is provided in connection with the third preferred embodiment a detonator in which the last segment is compacted under a pressure of about 4,000 psi.

In a seventh preferred embodiment of the present invention there is provided in connection with the third preferred embodiment a detonator in which the first segment is compacted under a pressure of about 2,000 psi, and the last segment is compacted under a pressure of about 4,000 psi.

In an eighth preferred embodiment of the present invention there is provided in connection with the first preferred embodiment an explosive pyrotechnic device selected from the group consisting of hand grenades, bombs, rockets, mortars, mines, satchel charges, bazooka shells, artillery shells, destructor assemblies, and ammunition. In a ninth preferred embodiment of the present invention there is provided in connection with the first preferred embodiment an explosive pyrotechnic device having an explosive charge used in rock blasting, mining, and/or oil drilling.

In a tenth preferred embodiment of the present invention there is provided a detonator formed entirely from a plurality of discrete segments of an insensitive energetic composition, each segment being formed by compacting under pressure powdered or granular insensitive energetic composition having a sensitivity to detonation which decreases with an increase in the amount of compressive force applied in compaction of the powder or granules of the insensitive energetic composition, said plurality of discrete segments comprising at least a first and last discrete segment of compacted insensitive energetic composition, each having been formed under different compaction pressures.

In an eleventh preferred embodiment of the present invention there is provided in connection with the tenth preferred embodiment a detonator in which said first segment is compacted under a compaction pressure low enough that ignition of the fuse or primer will effect detonation of said first segment without detonating either the main charge or any other segment of insensitive energetic composition.

In a twelfth preferred embodiment of the present invention there is provided in connection with the tenth preferred embodiment a detonator in which said last segment is subjected to a compaction pressure high enough that only ignition of a next to the last segment will initiate detonation of said last segment, which in turn causes detonation of the main charge.

In a thirteenth preferred embodiment of the present invention there is provided in connection with the tenth preferred embodiment a detonator in which the plurality of segments employed in the detonator are each compacted at different pressures from powder and/or granules of insensitive energetic composition so as to form an energetic train which sequences detonation of the individual segments starting with the first segment produced with the lowest compaction pressure and then progressing to a last segment compacted at a highest compaction pressure.

In a fourteenth preferred embodiment of the present invention there is provided in connection with the tenth preferred embodiment in which said first segment is compacted under a compaction pressure low enough that ignition of the fuse or primer will effect detonation of said first segment without detonating either the main charge or any other segment of the insensitive energetic composition, and said last segment being subjected to a compaction pressure high enough that only ignition of a next to the last segment will initiate detonation of said last segment, which in turn causes detonation of said main charge.

In a fifteenth preferred embodiment of the present invention there is provided in connection with the fourteenth embodiment a detonator in which the plurality of segments employed in the detonator are each compacted at different pressures from powder and/or granules of insensitive energetic composition so as to form an energetic train which sequences detonation of the individual segments starting with the segment produced under the lowest compaction pressure and then progressing to segments compacted under increasingly higher compaction pressures.

In a sixteenth preferred embodiment of the present invention there is provided in connection with the tenth preferred embodiment a detonator formed from granules and/or powdered RDX.

In a seventeenth preferred embodiment of the present invention there is provided in connection with the sixteenth preferred embodiment a detonator in which the first segment of RDX is compacted under a pressure of about 2,000 psi, and the last segment of RDX is compacted under a pressure of about 4,000 psi.

In an eighteenth preferred embodiment of the present invention there is provided in connection with the tenth preferred embodiment a detonator which is formed from granules and/or powdered HMX.

In a nineteenth preferred embodiment of the present invention there is provided in connection with the tenth preferred embodiment a pyrotechnic device selected from the group consisting of hand grenades, bombs, rockets, mortars, mines, satchel charges, bazooka shells, artillery shells, destructor assemblies, and ammunition.

In a twentieth preferred embodiment of the present invention there is provided a detonator formed entirely from a plurality of discrete segments of an insensitive energetic composition, each of said segments employed in the detonator being compacted at different pressures from powder and/or granules of insensitive energetic composition so as to form an energetic train which sequences detonation of the individual segments starting with a first segment in the detonation train produced under the lowest compaction pressure, and then progresses to segments compacted under higher compaction pressures until a last segment in the detonation train is initiated by a next to the last segment, and a main charge is initiated only by detonation of the last segment.

Further areas of applicability of the present invention will become apparent from the detailed description provided hereinafter. It should be understood that the detailed description and specific examples, while indicating preferred embodiments of the present invention, are intended for purposes of illustration only and are not intended to limit the scope of the invention.

BRIEF DESCRIPTION OF THE SEVERAL VIEWS OF THE DRAWINGS

Additional advantages and features of the present invention will become apparent from the subsequent description and appended claims, taken in conjunction with the accompanying drawings, wherein:

DETAILED DESCRIPTION OF THE INVENTION

Figure 1:
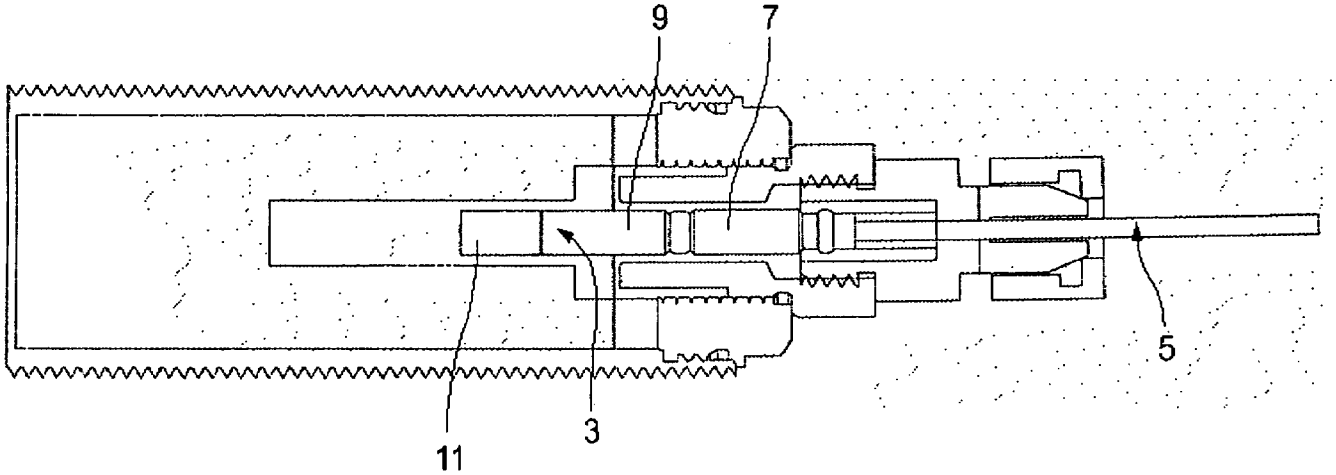
FIG. 1 (Prior Art)
FIG. 1 is a cross-sectional view of a conventional explosive device, illustrating particularly a conventional detonator used in a prior art detonation chain.
Figure 2:
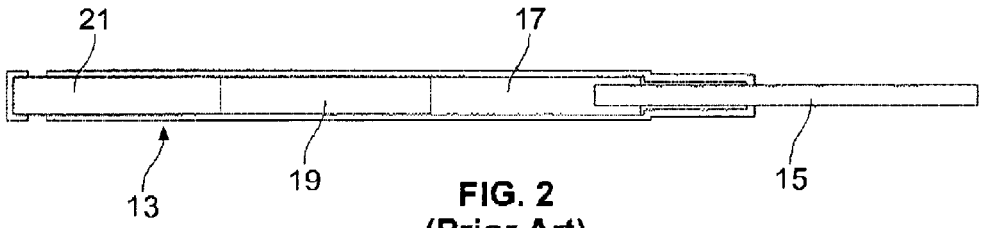
FIG. 2 (Prior Art)
FIG. 2 is a cross-sectional view of a conventional detonator, illustrating particularly the position of the conventional items used in the conventional detonator chain.
Figure 3:
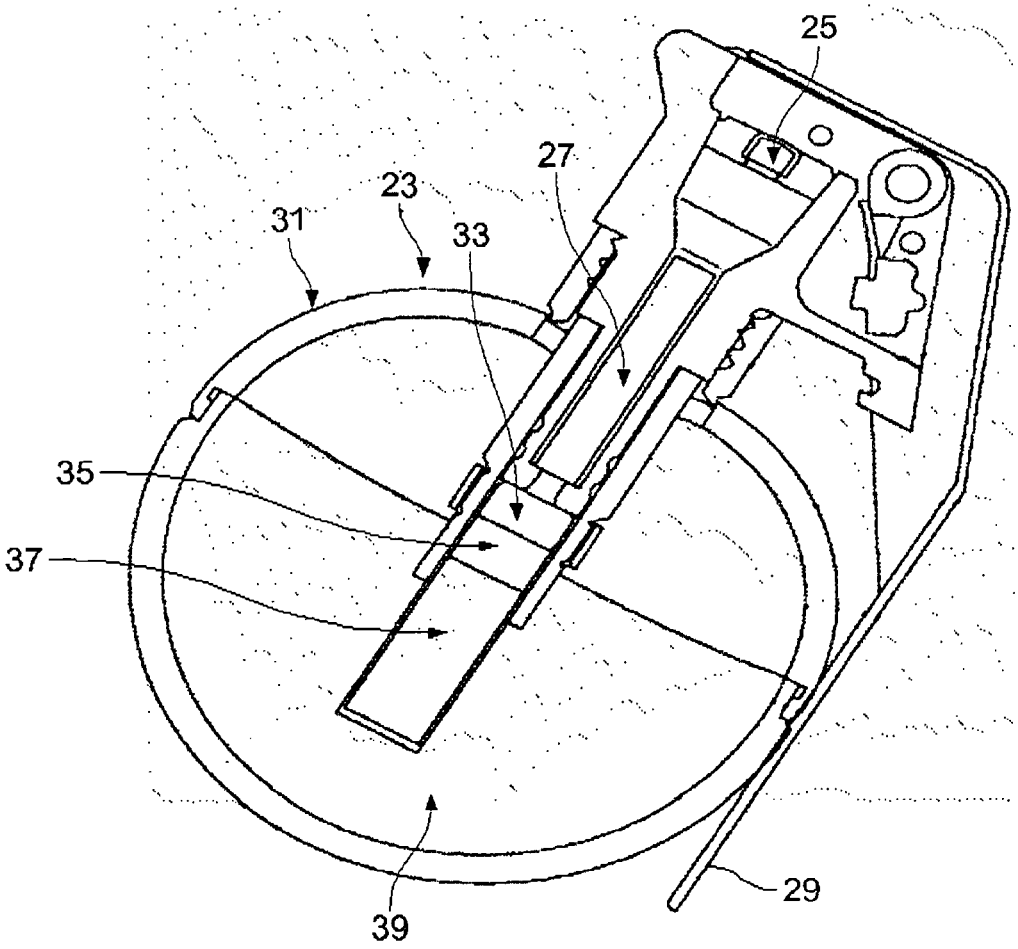
FIG. 3 (Prior Art)
FIG. 3 is a cross-sectional view of a conventional hand grenade, illustrating particularly the components of the detonator assembly.
Figure 4:
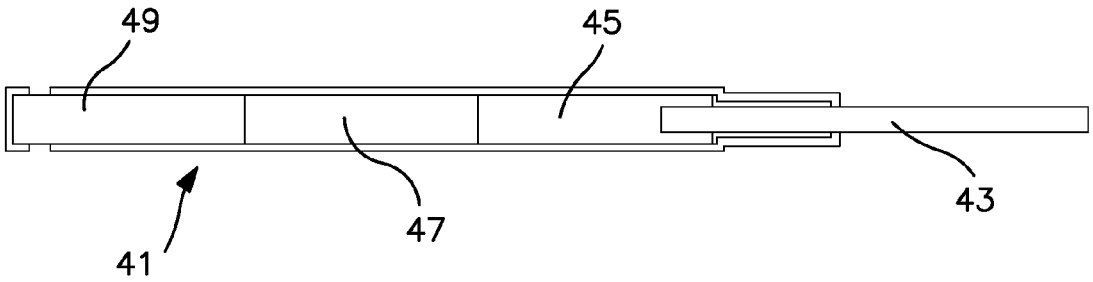
FIG. 4 is a cross-sectional view of a detonator of the present invention, illustrating particularly the use of multiple segments of compacted RDX replacing the lead azide and lead styphnate used in conventional detonators.

In a preferred embodiment of the present invention there is shown generally at 41 in FIG. 4 a detonator train comprising shock cord 43, burn mix 45 of RDX compacted under a pressure of about 2,000 psi, low order mix 47 of RDX compacted under a pressure of about 3,000 psi, and high order mix 49 of RDX compacted under a pressure of about 4,000 psi.

In FIG. 4, the high order mix 49 is the energetic segment at the desired compaction or pressing force pressure, in this case RDX compacted at a pressure of approximately 4,000 psi. At this pressure of compaction, it would be nearly impossible to initiate the RDX with shock cord 43 on a consistent basis. The next level of energetic compaction of RDX segments is the low order mix segment 47, which is approximately ⅓ to ½ less in compaction pressure as the high order mix compaction segment 49. This may or may not be enough for shock cord 47 to initiate the reaction, because the compaction of the energetic needs not only the energetic but also binders which are used to aid the compaction process so that the energetic does not react during pressing. These binders also maintain the compacted powder or granules after pressing and bond together the ingredients in the pressed segments.

Where further initiation improvements are desired, a third, fourth or more segments such as burn mix 45 may be included until the desired energetic train reaction is achieved. Each type of energetic chosen (such as RDX, Composition A-5, or HMX) for a particular type of detonator may require tailoring and adjustment of the number of segments of a particular energetic in the detonator train for the particular main charge to be detonated. The burn mix 45 compaction may be ⅓ to ½ less in compaction pressure as the previous segment. This general formula may not be ideal for all types of energetic, and needs to be evaluated and adjusted for each application as are current energetic mix methods, technology and industrial standards for explosive materials.

In accordance with the present invention, the previously used primary energetics (lead styphnate and/or lead azide) are eliminated and these primary energetic are replaced by detonating energetic high order mix segments, except these segments are compacted to a lower pressing pressure than the high order mix. In the detonator train of the present invention, a high order mix can be initiated using the same type of energetic materials as in the other segments of the detonator train, except produced at lower compaction pressures. In such cases, these high order mixes need large stimuli to initiate as is currently used with lead styphnate and lead azide as primary energetic. The low order and burn mix segments used in the detonator train of the present invention are used to replace the primary energetic of lead styphnate and lead azide, which results in a more insensitive munition (IM) energetic.

Detonators employing the use of the same type of high order energetic segments throughout the detonation train can be used in most detonator systems, fuse systems and military systems including destructor assemblies, grenades, mortars, military ammunition including artillery shells, mines, bombs, rockets and torpedos, etc.

Figure 5:
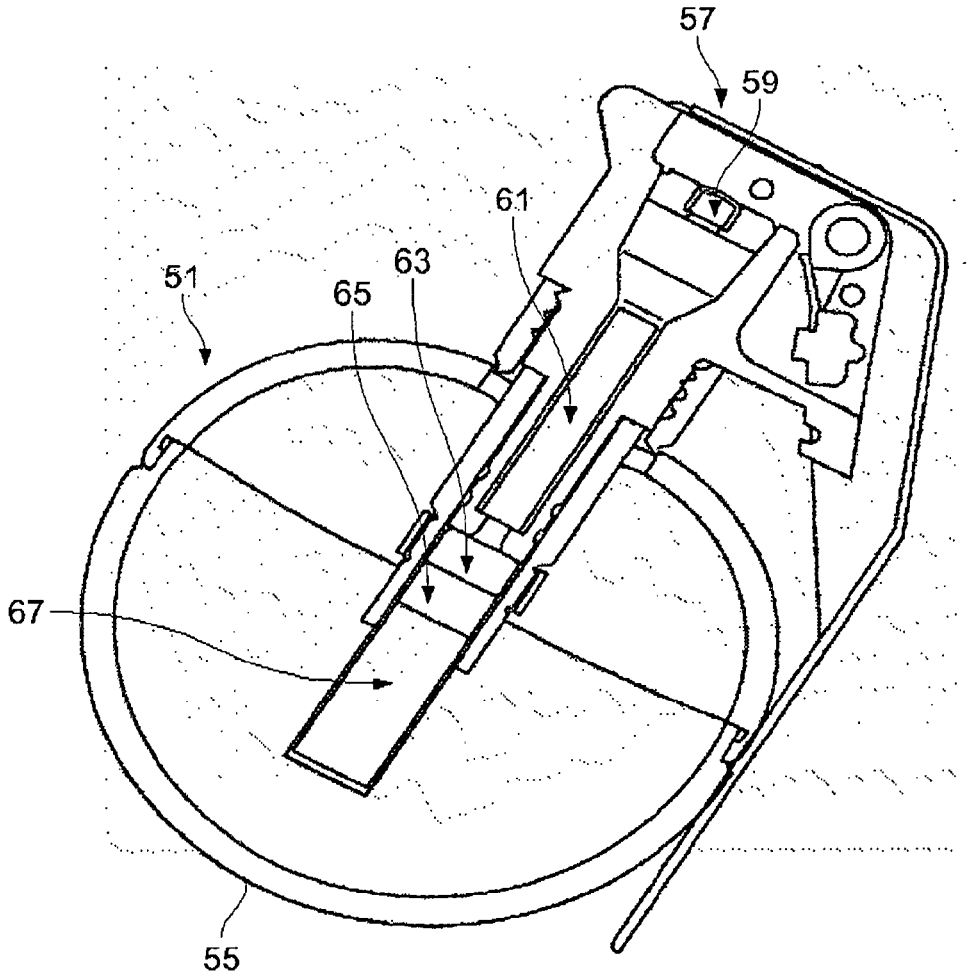
FIG. 5 is a cross-sectional view of a hand grenade made according to the present invention which employs a detonator having multiple segments of compacted RDX replacing the lead azide and lead styphnate used in conventional hand grenades.
Figure 6:
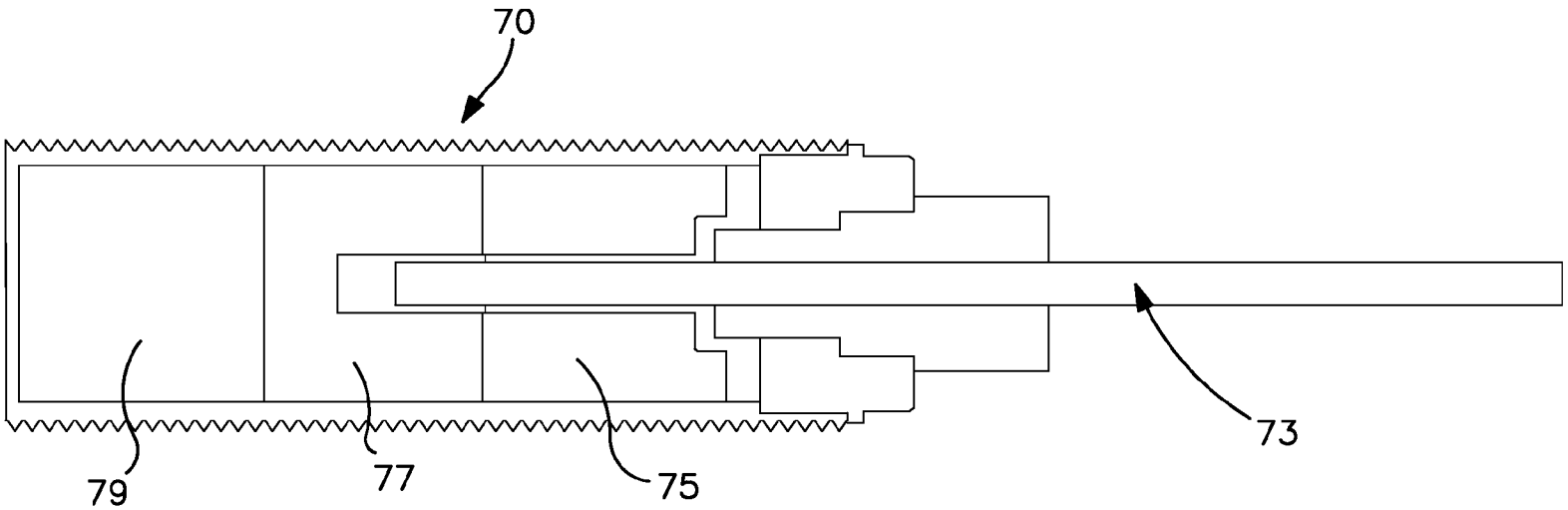
FIG. 6 is a cross-sectional view of an explosive device of the present invention in which a high order RDX mix main charge is initiated by a lower order segment of RDX, and a burn mix segment of RDX, in which the burn mix can be made with additional laminations at lower compaction pressures, such that either a shock cord or fuse can initiate the burn mix.

In another preferred embodiment of the present invention as illustrated in FIG. 5 a hand grenade shown generally at 51, which includes a fuse assembly having a primer 59, a first segment, or delay mix 61, a second segment or burn mix 63, a third segment or low order mix 65, and a fourth segment, or high order mix 67, in this conventional hand granade 51, the handle 57 is pulled away from the body 55 of the grenade 51 to initiate detonation of the primer 59. The primer then initiates detonation of delay mix 61, which in turn initiates detonation of burn mix 63 of RDX compacted under a pressure of about 2,000 psi, which in turn initiates detonation of the low order mix 65 of RDX compacted under a pressure of about 3,000 psi, which in turn initiates detonation of the high order mix 67 of RDX compacted under a pressure of about 4,000 psi, which in turn detonates the main energetic filling in body 55 of hand grenade 51. In another preferred embodiment of the present invention as illustrated in FIG. 6 is a detonator shown generally at 70 which comprises shock cord and/or fuse 73, burn mix 75 of RDX compacted under a pressure of about 2,000 psi, a low order mix 77 of RDX compacted under a pressure of about 3,000 psi, and a high order mix 79 of RDX compacted under a pressure of about 4,000 psi. Optionally, the burn mix can be made with additional laminations or segments at lower compaction pressures, such that either a shock cord or fuse can initiate the burn mix.

Although any insensitive energetic composition can be employed in the detonator of the present invention, when their sensitivity to detonation decreases with an increase in the amount of pressure applied during compaction of powders and/or granules of the insensitive energetic, it is preferred to employ granular or powdered energetic compositions selected from the group consisting of RDX, HMX, Composition A-3, Composition A-5, LX-04, LX-07, LX-09, LX-10, LX-11, LX-15, LX-16, LX-17, PBX-9007, PBX-9010, PBX-9011, PBX-9205, PBX-9404, PBX-9407, PRX-9501, PRX-9502, PBX-9503, PRX-9604, PRXN-5, AFX-601, AFX-902, AFX-511, AFX-521, PAX-2A, PAX-3, PAX-30, PAX-50, and PBXN-9.

Powder and/or granules of the insensitive energetic composition are commonly available industrially. These materials can be compacted in a die cavity filled with the energetic composition, by a mandrel which forces the powdered and/or granule insensitive composition into the die cavity under pressure. The pressure of compaction can be varied by adjusting the travel of the mandrel, and measuring the pressure of compaction. These compaction steps can be repeated for a second and third pressing to produce a burn mix which is the easiest to ignite.

In the present invention, the first segment of granular or powdered insensitive energetic is compacted to the lowest pressure which will produce a segment which can be initiated by the fuse or detonation cord to be used. The next segments of granular and/or powdered insensitive energetic are compacted under higher pressure which will produce one segment which can be initiated by detonation of the first segment. This process continues until a last segment of granular and/or powdered insensitive energetic is compacted under a pressure which will produce the last segment capable of initiation by the next to the last segment in the detonation train.

The size and compaction of the last segment is designed to initiate detonation of a main charge of insensitive energetic. However, the last segment in the detonation train is only initiated by detonation of a next to the last segment in the detonation train, and detonation of the next to the last segment is insufficient to initiate detonation of the main charge. Thus, this detonation train sequences detonation of these segments of insensitive energetic from a first segment having the lowest amount of compaction to a last segment having the highest amount of compaction. Therefore, detonation of the main charge can be achieved without the use of lead azide, and/or lead styphnate, or any other sensitive energetic material.

Detonators produced according to the present invention can also be used in police, SWAT, and other law enforcement activities. Additionally, the detonators of the present invention can be used in construction, rock blasting, mining, and oil drilling applications that can benefit from the use of less sensitive energetics. The detonators of the present invention are also less sensitive to radio waves, cell phones, microwaves and other frequencies that may initiate detonation of energetics of conventional explosives used in these fields. The use of conventional detonators exposes the users to great danger such as from an undesired initiation of explosives by radio waves.

The industry has made great strides in the undesired explosion area with the use of flying disk initiators that require high voltages to initiate an explosive, but this too may benefit from a less reactive energetic initiation detonator as described above.

It is to be understood that the present invention is not to be limited to the specific embodiments disclosed herein, but is intended to cover such variations as are traditional within the field of the invention. In addition, many modifications may be made to adapt a particular situation or material to the teachings of the invention without departing from the essential scope thereof. It is intended that the invention not be limited to the particular embodiments illustrated by the drawings and described in the specification as the best mode presently contemplated by this invention, but that the invention will include any embodiments falling within the foregoing description and appended claims.

What is claimed is:

1. A detonator for a pyrotechnic device consisting of a plurality of discrete segments of a single insensitive energetic composition, said plurality of discrete segments comprising at least a first, second and third discrete segment, wherein the plurality of segments are each compacted under different pressures from powder and/or granules of insensitive energetic composition so as to form an energetic train which sequences detonation of the individual segments starting with the first segment produced under the lowest compaction pressure and then progressing to the subsequent segments compacted under higher compaction pressures, wherein the first segment can only be ignited by a pyrotechnic fuse or detonation cord, and each subsequent segment can only be ignited by the segment immediately preceding it in the energetic train, and wherein the pyrotechnic device can only be ignited by the last segment.

2. The detonator of claim 1, wherein said detonator is formed from granules and/or powdered RDX.

3. The detonator of claim 2, wherein the first segment of RDX is compacted under a pressure of about 2,000 psi, and the last segment of RDX is compacted under a pressure of about 4,000 psi.

4. The detonator of claim 1, wherein said detonator is formed from granules and/or powdered HMX.

5. The detonator of claim 1, wherein the pyrotechnic device is selected from the group consisting of hand grenades, bombs, rockets, mortars, mines, satchel charges, bazooka shells, artillery shells, destructor assemblies, and ammunition.

* * * * *